US008382393B1

(12) United States Patent
Phillips

(10) Patent No.: US 8,382,393 B1
(45) Date of Patent: Feb. 26, 2013

(54) TEMPORARY ROADWAY FOR MOVING HEAVY EQUIPMENT ON AN INCLINE AND STEEP GRADES INCLUDING SYNTHETIC INTER-CONNECTABLE MOVABLE AND REMOVABLE STRUCTURAL MATS

(75) Inventor: Mark L. Phillips, Lafayette, LA (US)

(73) Assignee: HB Green Resources, LLC, Lafayette, LA (US)

( * ) Notice: Subject to any disclaimer, the term of this patent is extended or adjusted under 35 U.S.C. 154(b) by 26 days.

(21) Appl. No.: 13/163,142

(22) Filed: Jun. 17, 2011

(51) Int. Cl.
*E01C 5/22* (2006.01)

(52) U.S. Cl. ..... 404/35; 404/34; 404/36; 404/44; 404/47; 52/177

(58) Field of Classification Search ..... 404/31, 404/34–36, 46, 47, 44; 52/177
See application file for complete search history.

(56) References Cited

U.S. PATENT DOCUMENTS 4,244,841 A * 1/1981 Frankland ..... 521/43.5
4,540,624 A * 9/1985 Cannady, Jr. ..... 442/246
4,851,500 A * 7/1989 Lalwani et al. ..... 528/487
5,316,408 A * 5/1994 Stanley et al. ..... 404/35
5,653,551 A * 8/1997 Seaux ..... 404/35
5,759,680 A * 6/1998 Brooks et al. ..... 428/326
5,783,286 A * 7/1998 DiNicola ..... 428/188
5,886,078 A * 3/1999 Sullivan et al. ..... 524/449
5,907,934 A * 6/1999 Austin ..... 52/177
6,380,309 B1 * 4/2002 Parker et al. ..... 525/166
7,500,336 B2 * 3/2009 McGivern et al. ..... 52/650.3
7,819,607 B2 * 10/2010 Carreras-Maldonado et al. ..... 404/34
7,985,475 B2 * 7/2011 Dubrow ..... 428/359
2002/0178661 A1 * 12/2002 Burke et al. ..... 52/177
2009/0266010 A1 * 10/2009 Lomske et al. ..... 52/173.1
2011/0247285 A1 * 10/2011 Wybo et al. ..... 52/309.1

* cited by examiner

*Primary Examiner* — Raymond W Addie
(74) *Attorney, Agent, or Firm* — Buskop Law Group, PC; Wendy Buskop

(57) ABSTRACT

A temporary roadway with a static resistant synthetic inter-connectable structural mats which connect without tools or fasteners having a top layer, a middle layer and a bottom layer. The static resistant synthetic inter-connectable structural mats can have static charge conduction conduit through the mat and the mats can be made from 100 percent recycled rust proof, non-absorbing materials.

13 Claims, 3 Drawing Sheets

TEMPORARY ROADWAY FOR MOVING HEAVY EQUIPMENT ON AN INCLINE AND STEEP GRADES INCLUDING SYNTHETIC INTER-CONNECTABLE MOVABLE AND REMOVABLE STRUCTURAL MATS

FIELD

The present embodiments generally relate to a temporary roadway with a static resistant synthetic inter-connectable structural mat.

BACKGROUND

A need exists for a temporary roadway with a static resistant synthetic inter-connectable structural mat particularly when temporary roadways are being laid on mountainsides and improved holding power of the mat is needed to retain the temporary roadway safely.

The present embodiments meet these needs.

BRIEF DESCRIPTION OF THE FIGURES

The detailed description will be better understood in conjunction with the accompanying drawings as follows.

Figure 1:
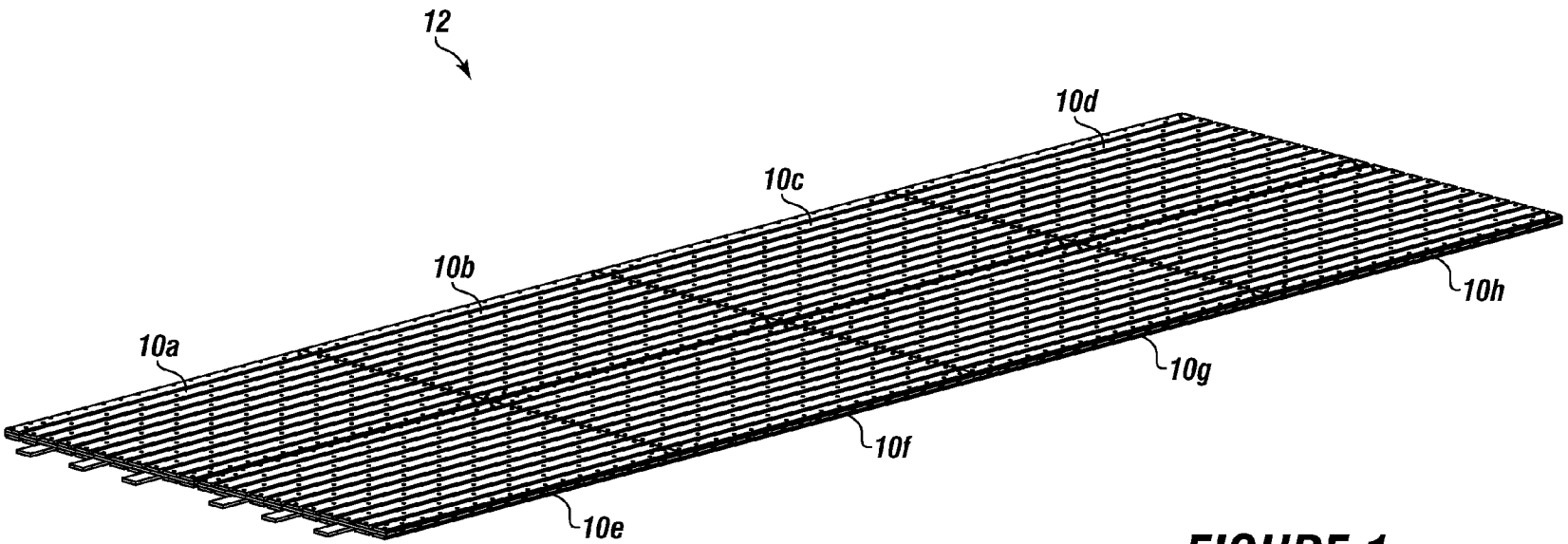
FIG. 1 is a diagram of several modular interconnected mats supporting a temporary roadway.

The present embodiments are detailed below with reference to the listed Figures.

DETAILED DESCRIPTION OF THE EMBODIMENTS

Before explaining the present assembly in detail, it is to be understood that the assembly is not limited to the particular embodiments and that it can be practiced or carried out in various ways.

The present embodiments relate to an assembly of structural mats made with a unique formulation to serve as a temporary roadway.

The temporary roadway can be a plurality of static resistant synthetic modular inter-connectable structural mats that are temporarily connectable and dis-connectable without fasteners or adhesives to create a length from up to several miles, or as along as the temporary roadway is needed to be.

The mats can be modular, static resistant and non-skid and can withstand at least 1000 pounds of load per square foot and up to 20 tons of load per mat without deforming.

Static electricity in one form or another is a phenomenon of nature and often results in electrostatic discharges that can cause fires and explosions.

Improved static resistant mats are needed for the transfer of machinery such as earth moving equipment that do not have rubber tires. Earth moving equipment, like bulldozers, which have treads, can build up a static charge, which can be harmful to the equipment and to the operator.

The present embodiments provide a temporary roadway that can reduce static charge buildup for large digging and transportable equipment, which do not use rubber tires.

The present embodiments of the temporary roadway, uses post consumer recycled materials and hence is friendlier to the environment. The temporary roadway can be made from post consumer shredded tires and bottles, such as detergent bottles like TIDE™ bottles.

The entire roadway can be "factory built" rather than created in place, which can be a significant labor savings procedure. Traditional "build in place" roadway takes more time and labor to create than simply creating a roadway by assembling factory built components.

The temporary roadway can provide a lower cost roadway by providing a factory build load bearing static charge dissipating structure that can be simply slide into The temporary roadway is inter-connectable without the need of screws, or other tools in the field to create an interconnected support structure that can facilitate non-temporary roadway repair, repair of pipelines, or installation of pipelines.

The embodiments can create a structural mat that is designed to allow a unique interlocking of the mats so that no "in the field" expertise is required and "in the field" welding, adhesives or fasteners are needed.

The temporary roadway has static resistant material protruding through the surface of the formulation used to create the roadway in segments of the outer surface effectively prevents stray electrical currents. The temporary roadway can be assembled quickly in the field.

The temporary roadway can be formed using lag screws and bolts which are conductive of static charge, allowing a decentralized and continuous dissipation of electrical charge while preventing temporary roadway degradation. The lag screws and bolts can be made of metal.

As another feature, the temporary roadway can support between 2000 pounds and 2 tons without deforming.

By using recycled materials, this temporary roadway can have a very low fossil fuel foot print. By using recycled tires and detergent bottles the temporary roadway uses materials that otherwise might end up in creeks, on beaches creating trash and litter.

The temporary roadway can be form where no tar, bitumen, or additional oil is needed to make the temporary roads created with structural mats, and accordingly, the temporary roads can also be removed.

The temporary roadway can be modular enabling the components of the roadway to be transported using conventional trucks on conventional roadways without a special permit.

The temporary roadway is non-porous and highly resistant to corrosive materials.

Each inter-connectable structural mat can be made from a plurality of synthetic structural boards, the plurality of synthetic structural boards can include ground plastic particles. The ground plastic particles can be from about 50 percent by weight based on the total blend to about 10 percent by weight based on the total blend.

The ground plastic particles can have diameters ranging from about 1/16 of an inch to about 1/4 of an inch. The ground plastic particles can bee blends of high density polyethylene (HDPE) particles and with polyethylene terephthalate particles or blends of low density polyethylene (LDPE) particles with high density polyethylene with polyterephalate.

The blend ratio of HDPE or combinations of HDPE and LDPE to polyethylene terephthalate particles can range from 10:1 to 1:10.

To the ground plastic particles, rubber can be added, from about 50 percent to about 80 percent by weight based on the total blend, which can be 100 percent ground styrene-butadiene rubber particles.

The ground styrene-butadiene rubber particles can have a diameter from about 1/16 of an inch to about 1/4 of an inch. The ground styrene-butadiene rubber can come from used tires, which can be cut using a high shear cutting device, such as a continuous feed high speed cutter.

To the blend of ground styrene-butadiene rubber with ground plastic particles, antistatic particles can be added from about 2 percent to about 10 percent by weight based of the total blend, which can be used for preventing static charge buildup in the resultant structural boards. Carbon black can be used for lowering the static charge buildup.

The antistatic particles can have a diameter from about 1/16 of an inch to about 1/4 of an inch.

To the blend of ground styrene-butadiene rubber, ground plastic particles with antistatic particles, an ultraviolet stabilizer material can be added from about 0.5 percent to about 5 percent by weight based on the total blend.

The ultraviolet stabilizer material can have a diameter from about 1/16 of an inch to about 1/4 of an inch. The resultant formulation can be referred to herein as the "total blend."

To create the structural boards used to make the mats that can be used to form the temporary roadway, the total blend can be placed into an extruder, such as a single screw banbury type extruder for heating and mixing using a temperature from about 200 degrees Fahrenheit to about 385 degrees Fahrenheit, or until a homogenous mixture is created as the extrudate.

The extruder heats and mixes until the blend of ground particles are extrudable into a static resistant structural extrudate which has the antistatic material partially protruding through an outer surface of the extrudate.

The antistatic particles can be blended and randomly connected to each other, which unexpectedly facilitates dissipation of static charge buildup in the structural boards, creating a density of at least 10 particles per square inch. The extrudate can dissipate voltage when the voltage is from about $10^{-5}$ volts to about $10^{-12}$ volts.

In one or more embodiments, the antistatic particles can be dissipaters that prevent static electrical buildup and maintain a voltage dissipation at or below $10^{-11}$ volts.

In an embodiment, while the extrudate is still warm, a slip resistant material can be partially embedded in the surface.

In an embodiment, the slip resistant coating can be deposited at least partially, such as over from about 50 percent to about 75 percent of the surface area of the extrudate.

While the static resistant extrudate cools from about 10 degrees Fahrenheit to about 30 degrees Fahrenheit, the slip resistant material becomes attached to the extrudate without the need for fasteners or adhesives, providing partial encapsulation of the slip resistant material to ensure it stays on the extrudate.

The thickness of the slip resistant material can range from about 1/16 of an inch to about 3/16 of an inch into the extrudate. The slip resistant material can be nylon, (a polyamide), a low density polyurethane, and ethylene vinyl acetate (EVA), which can also be static resistant material. The nylon and EVA can be blended together in the extruder in another embodiment.

In another embodiment, the extrudate, once cooled can be made slip resistant by forming at least one groove longitudinally in each extrudate on a top surface, wherein each groove has a depth from about 1/16 of an inch to about 3/16 of an inch and about 1/2 of an inch wide. In embodiments, additional grooves can be formed in the structural boards.

In still another embodiment, the extrudate can be made into a board which can have a bevel formed on one of the edges. The bevel, in this embodiment, can act as a non-slip feature. The bevel can be a 30 degree to 45 degree sloping face on one side of each of the formed boards.

The slip resistant material can be from about 0.01 percent to about 6 percent by weight of the total weight of the extrudate.

After the slip resistant coating is placed on the extrudate, the at least partially coated extrudate can then be cooled, such as in a water bath, or a bath of a liquid that is not harmful to the environment, in the case of a spill.

The extrudate can be extruded in the form of a structural board, with or without the slip resistant material in different embodiments.

Multiple mats which can be co-joined together, which can be made from a plurality of the formed structural boards.

Each mat that is a component of the temporary roadway can be created by first forming a layer of these boards, termed "bottom boards" in a "jig," which can also be termed herein as a "fixture".

The bottom boards can have a length which enables the resultant mat to be transported by truck over a roadway to create the temporary roadway without special transport permits.

The bottom boards can each have a length from about 4 feet to about 12 feet to be usable herein. The bottom boards can be placed parallel with each other in the jig. In an embodiment, the boards can be spaced apart from about 1/4 of an inch to about 1/2 of an inch.

In embodiments, at least 3 bottom boards and up to 5 bottom boards can be positioned to extend beyond a perimeter of the jig, to create at least 3 spaces and up to 5 spaces in the bottom boards for engagement with a fork lift or with another mat.

The bottom boards can be positioned in a first direction termed herein "a first orientation".

Positioned over these bottom boards are middle boards, which can have the same formulation and can be formed in the same manner as the bottom boards.

The middle boards can be positioned in a second orientation, such as at a 90 degree angle from the first orientation of the bottom boards.

In another embodiment, the second orientation can be on a bias, such as an angle from about 30 degrees to about 50 degrees.

The middle boards can be positioned in parallel to each other and spaced in a similar spacing as the bottom boards, which can range from about 1/2 of an inch to about 1/8 of an inch.

The middle boards do not cover the extending portion of the extending bottom boards.

Top boards can be positioned over the middle boards. Top boards can be made of the same formulation as the bottom and middle boards. The top boards can be positioned in the first orientation parallel with the bottom boards.

In an embodiment, the top boards can be positioned parallel to each other and spaced apart from flush against each other from about 1/4 of an inch to about 1 inch.

The top boards can cover all the middle boards and do not cover the extending portion of the extending bottom boards.

A mat perimeter can be formed when the three layers of structural boards are positioned over each other.

Extended portions of the bottom layer extend at the same length beyond the perimeter in an embodiment. In this embodiment, both the extended portions of the top layer and the bottom layer extend beyond the perimeter, but on opposing ends of the formed mat assembly, as can be seen in the Figures.

The mat can be assembled by first drilling holes through the top boards, the middle boards and partially into the bottom boards. Next, lag screws can be installed in the holes, termed "pilot holes" to secure the three layers of structural boards together forming the mat that can be inter-connected to create the temporary roadway.

In embodiments, from about 10 lag screws to about 20 lag screws and bolts can be used per board. The lag screws and bolts can be used to totally penetrate the top structural boards, the middle structural boards to partially extend into the bottom structural boards and thereby provide a static charge conduit through the formed mat from the top surface of the mat to a ground, which prevents static buildup on the temporary roadway.

The layered structure with antistatic material protruding through the surface of the structural boards, the plurality of openings and extensions provides an antistatic mat for supporting loads that is easy to lift, while supplying a secure interlock with other boards without the need for additional tools or materials, and the lag screws extending from the top structural boards, the middle structural boards and partially into the bottom structural boards form a static resistant synthetic inter-connectable structural mat.

The formed mats, whether interlocked or not, can support vehicles, heavy equipment while simultaneously providing resistance to corrosive materials, and having the ability to be transported using conventional trucks on conventional roadways without a permit.

In embodiments, the mats can use structural boards that can be from about 8 feet to about 12 feet long, from about 7 inches to about 9 inches wide, and from about 1.5 inches to about 2 inches thick.

In an embodiment, from about 9 structural boards to about 12 structural boards can be used in the bottom layer. The bottom layer members can be positioned in a fixture in a first orientation, termed herein a "longitudinal" orientation, and the bottom layer can create a perimeter.

Three alternating board members of the bottom layer members can be positioned to extend at from about 7 inches to about 14 inches from the bottom perimeter to provide a male mating portion for this first bottom layer with a female mating portion of a bottom layer of another mat. This male/female mating can allow for engagement in the field of the mats without using tools or special training.

In the fixture, middle structural boards can be positioned in a second orientation.

In this embodiment, the middle layer can use from about 15 parallel static resistance structural boards to about 20 parallel static resistance structural boards, wherein each middle structural member can be from about 7 feet to about 8 feet long. This length can allow the mats to be transported by truck.

The middle layer in this embodiment can have the structural board members oriented at about a 90 degree orientation to the bottom layer first orientation. A top layer of the structural board members can be positioned over the middle layer, again in the first orientation.

The top layer can use from about 9 parallel static resistance structural members to about 13 parallel static resistance structural members. These members can be spaced apart from flush to about ½ of an inch apart.

Pilot holes can be formed in the top layer, the middle layer and partially through the bottom layer. The diameter of the pilot holes can range from about ⅛ of an inch to about ¾ of an inch.

The lag screws can be positioned through the pilot holes. The lag screws can be counter sunk in each pilot hole to a depth from about 1/16 of an inch to about 3/16 of an inch. Once the lag screws are sunk into the pilot holes, the formed three-layered mat with extensions and openings can then be removed from the fixture or jig.

In an embodiment, a mat can be formed having a bottom layer of about 11 boards to about 12 boards with at least a ½ inch gap between boards.

Still another embodiment, the bottom layer can have from about 9 structural members to about 12 structural members, wherein the structural members can all be parallel. Each of the structural members can be a static resistant structural member from about 9 feet to about 12 feet in length.

In an embodiment, each of the structural members can be a partially slip resistant coated static resistant structural member.

The structural members can be positioned in the fixture at a first orientation or a "longitudinal" orientation and the bottom layer can create a bottom perimeter.

A middle layer of structural members can then be positioned in a second orientation in the fixture, overlaying the bottom layer.

The middle layer can use from about 15 structural board members to about 20 structural board members, wherein each structural board member can be parallel to the other, and each static resistance structural members can be from about 6 feet to about 8 feet in length.

A top layer can use from about 9 structural board members to about 14 structural board members, which can be parallel to each other and can be placed over the middle layer. In each layer the structural board members can be static resistant structural members as described above, in which the formulation can contain from about 10 percent to about 50 percent by weight of ground plastic particles and from about 50 percent to about 80 percent by weight of ground styrene-butadiene rubber particles.

In this version, an upper L-shaped lip can be formed at one longitudinal end of the bottom layer and a lower opposing L-shaped lip can be formed at the opposite longitudinal end of the top layer.

These lips can be formed by attaching to extended structural members from the perimeter, a lip edge particularly, attaching an upper L-shaped lip to extend downwardly, and a lower L-shaped lip to extend upwardly allowing the lower L-shaped lip to engage the upper L shaped lip of an adjacent mat, forming a lip lock.

The extended portions can be alternating structural boards. All the extended portions can extend at the same distance forming corresponding opening in the opposite ends. Onto these extended portions, a lip edge can be created.

In another embodiment, the assembly can use from about 0.01 percent to about 3 percent by weight of the total weight, of a non-caustic soda with the ground plastic particles to prevent curling of the boards.

This non-caustic soda can be baking soda, and can be used to prevent curling of the boards in temperatures below 45 degrees Fahrenheit.

The mat protects the temporary roadway from static charge buildup which reduces the temporary roadway's attraction to lighting, which can significantly improve safety.

In an embodiment, the top layer can provide gaps between the structural boards which are only large enough to allow water to flow from the top surface, preventing water build up around the temporary roadway while allowing workers to safely stand on the mats and additional tools to be supported on the mats without the tools falling through the cracks becoming non-retrievable.

The Figures depict the lip embodiment of the mat in more detail. In general, both the bottom and top layers can be oriented to have the extended portions as previously described for just the bottom layer.

Turning now to the Figures, FIG. 1 is a diagram of a temporary roadway with a plurality of mats 10*a*, 10*b*, 10*c*, 10*d*, 10*e*, 10*f*, 10*g* and 10*h* depicted interconnected forming the temporary roadway 12.

Figure 2:
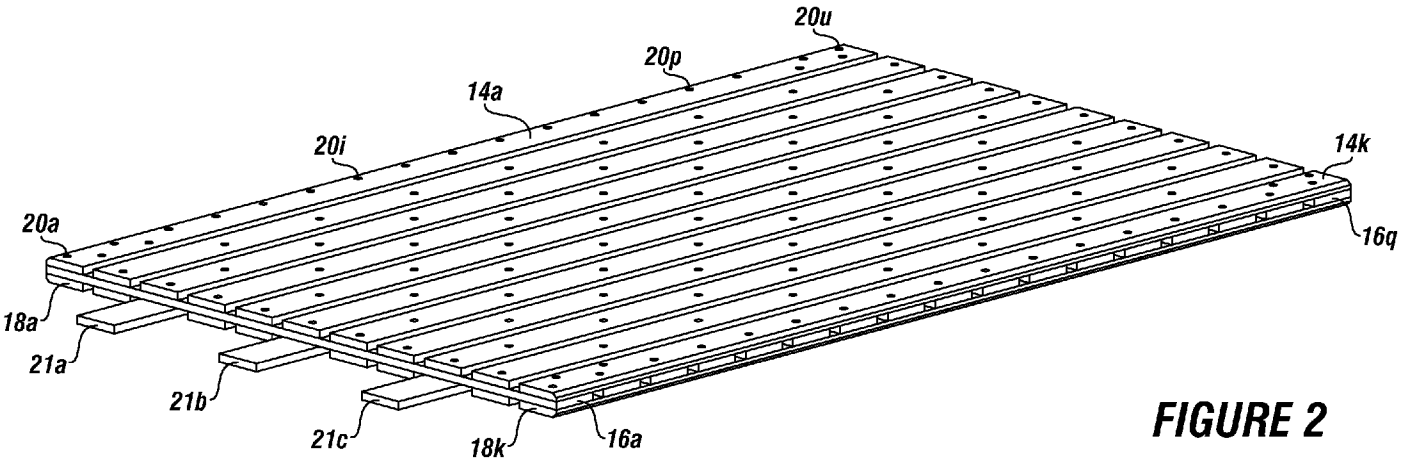
FIG. 2 is a top perspective view of an assembled three-layered mat with the extending portions.

FIG. 2 a top perspective view of an assembled three-layered mat with the extending portions.

The mats are each constructed forming a top layer from a plurality of top layer structural boards 14*a*-14*k*, forming a middle layer from a plurality of middle layer structural boards 16*a*-16*q*, and forming a bottom layer from a plurality of bottom layer structural boards 18*a*-18*k*. In this Figure, the top layer is shown connected to the middle layer and bottom layer with a plurality of lag screws and bolts 20*a*-20*u*.

The structural boards can be made from an extruded blend of ground particles which can include: (i) 50 percent by weight to 30 percent by weight based on the total blend of ground plastic particles of high density polyethylene particles, and polyethylene terephthalate particles, or combinations thereof; (ii) 50 percent by weight to 80 percent by weight based on the total blend of rubber, which can be 100 percent ground styrene-butadiene rubber particles; (iii) from 2 percent by weight to 10 percent by weight based on the total blend of antistatic particles for preventing static charge buildup; (iv) 0.5 percent by weight to 5 percent by weight based on the total blend of an ultraviolet stabilizer material, then placing the blend of ground particles into an extruder for heating and mixing using a temperature from about 200 degrees Fahrenheit to about 385 degrees Fahrenheit until the blend of ground particles are extrudable into a static resistant structural board; wherein the antistatic material partially protrudes through an outer surface of the static resistant structural board; coating the static resistant structural board while the board is at a temperature from about 200 degrees Fahrenheit to about 385 degrees Fahrenheit with a slip resistant material forming the partially slip resistant coated static resistant structural board. The slip resistant material can be carbon fibers.

The slip resistant coating can be from about 0.01 percent by weight to about 6 percent by weight of the total weight of the partially slip resistant coated static resistant structural board. After integrating the coating into the material of the board, such as by partial encapsulation, the board can then be cooled to form the partially slip resistant coated static resistant structural boards usable with the temporary roadway.

In an embodiment, only these ingredients can be used in the formulation to provide maximum strength, load support to about 5000 pounds when the formulation is less than about 2 inches thick, and resistance to toxic substances, such as oil, and essentially zero porosity to resist collection of water or other toxic materials at a drill site.

In embodiments, the antistatic material can be blended in the formulation and create various random particle connections with other antistatic particles to facilitate dissipation of static charge buildup in the structural boards, and creating a density of at least 10 particles per square inch.

In this Figure, the extended portions 21*a*, 21*b*, and 21*c* of three of the bottom layer boards are depicted. By extending these boards a preset amount, corresponding holes can be formed in the opposite end of the formed mat.

Figure 3:
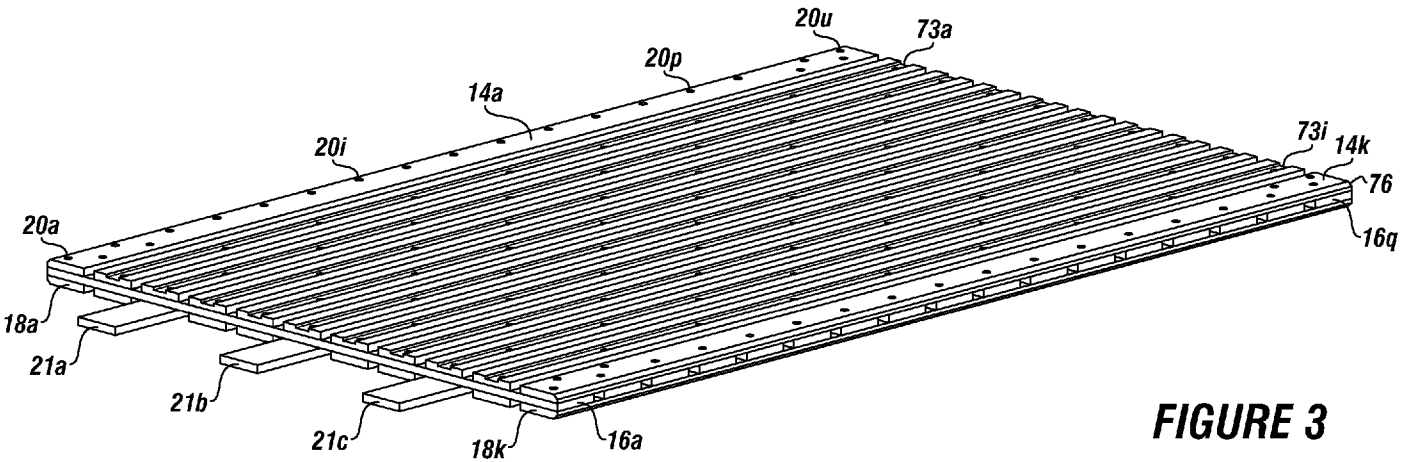
FIG. 3 is a detailed perspective view of an assembled three-layered mat with extending portions and slip resistant features.

FIG. 3 is a top perspective view of an assembled three-layered mat with the extending portions and slip resistant features.

The mats are each constructed by forming a top layer from a plurality of top layer structural boards 14*a*-14*k*, forming a middle layer from a plurality of middle layer structural boards 16*a*-16*q*, and forming a bottom layer from a plurality of bottom layer structural boards 18*a*-18*k*. In this Figure, thee top layer is shown connected to the middle layer and bottom layer with a plurality of lag screws and screws 20*a*-20*u*.

The structural boards can be made from an extruded blend of ground particles which can include: (i) 90 percent by weight based on the total blend of ground plastic particles of high density polyethylene particles, and polyethylene terephthalate particles, or combinations thereof; (ii) 2 percent by weight based on the total blend of rubber which can be 100 percent ground styrene-butadiene rubber particles; (iii) 2 percent by weight based on the total blend of antistatic particles for preventing static charge buildup; (iv) 5 percent by weight based on the total blend of an ultraviolet stabilizer material, then placing the blend of ground particles into an extruder for heating and mixing using a temperature from about 200 degrees Fahrenheit to about and 385 degrees Fahrenheit until the blend of ground particles are extrudable into a static resistant structural board. The antistatic material partially protrudes through an outer surface of the static resistant structural board; coating the static resistant structural board while the board is at a temperature from about 200 degrees Fahrenheit to about and 385 degrees Fahrenheit. Additionally, 1 percent by weight of a slip resistant material can be pushed into the extrudate.

In an embodiment, the slip resistant grooves 73*a*-73*i* can be formed in the extrudate as seen in FIG. 3. A beveled edge 76 can also be formed on the boards for slip resistance.

Additionally in this embodiment the formed boards can have a resistance to toxic substances, such as oil, and essentially zero porosity to resist collection of water or other toxic materials at a drill site.

It can be noted that the random particle connections with other antistatic particles can be formed in the boards of the mats to facilitate dissipation of static charge buildup in the structural boards, and creating a density of at least 10 particles per square inch.

In this Figure, the extended portions 21*a*, 21*b*, and 21*c* of three of the plurality of bottom layer structural boards are depicted. The extended portions form corresponding holes in the opposite end of the formed mat.

Figure 4:
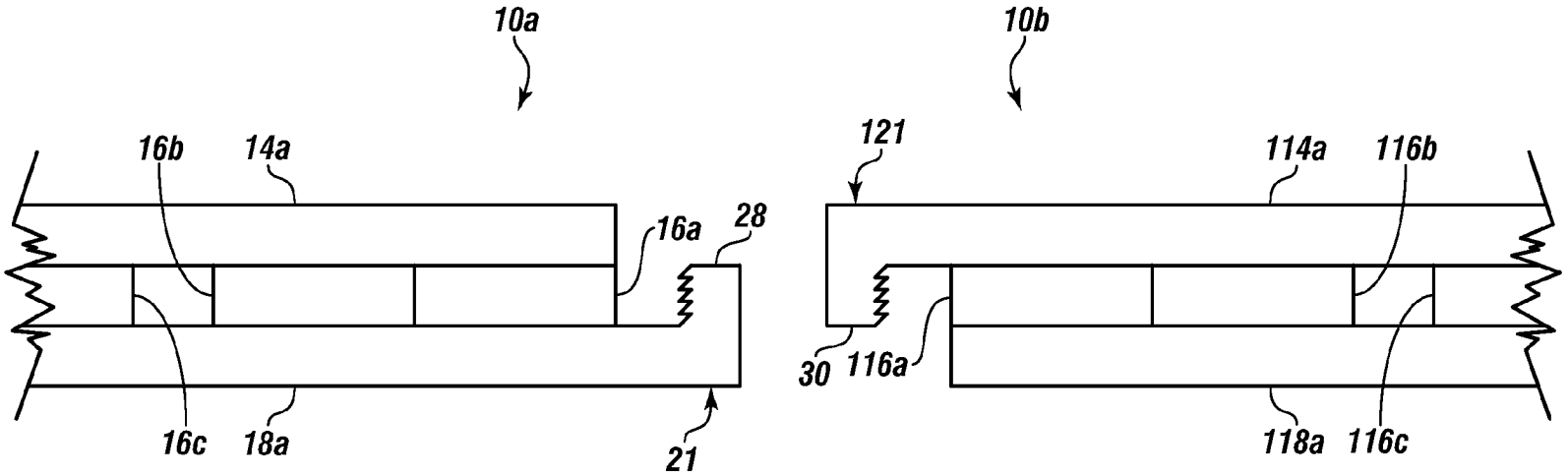
FIG. 4 is a side view of two inter-connectable mats usable under the temporary roadway with L-shaped lips locking the mats together.

FIG. 4 shows the bottom layer structural board 18*a* of a first mat 10*a* depicted with a bottom layer extended portion 21 having a bottom lip 28 that extends toward the top layer structural board 114*a* of an adjacent or second mat 10*b*.

The first mat 10*a* is shown in this Figure with a top layer structural board 14*a*, middle layer structural boards 16*a*, 16*b* and 16*c* and a bottom layer structural board 18*a*.

The second mat 10*b* is shown in this figure with a top layer structural board 114*a*, middle layer structural boards 116*a*, 116*b* and 116*c* and a bottom layer structural board 118*a*.

Each bottom lip can be the width of a bottom layer structural board, and have a length from about 3 inches to about 14 inches, and a height from the bottom layer structural board from about 1 inches to about 7 inches.

The top layer structural board 114*a* of an adjacent or second mat 10*b* is shown having top extended portion 121 having a top lip 30, which can have a different size than the bottom lip. In another embodiment, the top lip can have the same size and characteristics as the bottom lip. The top lip 30 can be mounted in a downward positioning facing the bottom layer structural board 18*a*.

The top lip and the bottom lip in an embodiment can be installed on the top and bottom boards while the boards are still warm, and then additionally held in place with lag screws and bolts, allowing the lip to have a seamless integration into the boards.

Examples of various specific formulations of the structural boards follow:

Example 1

The ground blend consists of 91 percent by weight based on the total blend of ground plastic particles, of which 40 percent is high density polyethylene particles and 60 percent is polyethylene terephthalate particles; (ii) 3 percent by weight based on the total blend of ground styrene-butadiene rubber particles; (iii) 2 percent by weight based on the total blend of an antistatic particles for preventing static charge buildup, wherein the antistatic particles have a diameter from about ⅛ of an inch to about ¼ of an inch to allow for partial protrusion through a formed outer surface and randomized particle connections with each other to facilitate dissipation of static charge buildup in the structural boards, and creating a density of at least 10 particles per square inch.

To the plastic particles are also added 3 percent by weight based on the total blend of an ultraviolet stabilizer material; and 1 percent by weight based on the total weight of the blend of a slip resistant coating.

Example 2

The ground blend consists of 91 percent by weight based on the total blend of ground plastic particles which are 60 percent high density polyethylene particles; and 40 percent polyethylene terephthalate particles; 2 percent by weight based on the total blend of ground styrene-butadiene rubber particles; 4 percent by weight based on the total blend of antistatic particles for preventing static charge buildup, wherein the antistatic particles have a diameter from about ⅛ of an inch to about ¼ of an inch to allow for partial protrusion through a formed outer surface.

It can be noted that the antistatic particles are blended during mixing creating randomized particle connections with each other to facilitate dissipation of static charge buildup in the structural boards, and creating a density of at least 10 particles per square inch.

In this example, there is also added to the plastic particles 1.5 percent by weight based on the total blend of an ultraviolet stabilizer material; and 1.5 percent by weight based on the total weight of the blend of a slip resistant material, such as nylon or EVA or combinations thereof.

Example 3

The ground blend consists of 79.5 percent by weight based on the total blend of ground plastic particles having 10 percent high density polyethylene particles; and 90 percent polyethylene terephthalate particles; (ii) 3.5 percent by weight based on the total blend of ground styrene-butadiene rubber particles; (iii) 10 percent by weight based on the total blend of an antistatic particles for preventing static charge buildup, wherein the antistatic particles have a diameter from about ⅛ of an inch to about ¼ of an inch to allow for partial protrusion through a formed outer surface and randomized particle connections with each other to facilitate dissipation of static charge buildup in the structural boards, and creating a density of at least 10 particles per square inch.

To the plastic particles is also added 4 percent by weight based on the total blend of an ultraviolet stabilizer material; and 3 percent by weight based on the total weight of the blend of a nylon slip resistant material.

To all of these examples, can be added from 0.01 percent by weight to 3.0 percent by weight of the total weight, of a non-caustic soda with the ground plastic particles to prevent curling. The non-caustic soda can be baking soda. The non-caustic soda prevents curling from temperature variations from the temperatures of materials on the mat to the outside temperatures.

In another embodiment it can be noted that using 4 and ½ inch lag screws provide a highly conductive conduit in forming the mats.

In another embodiment, the method can include the step of colorizing the boards based on content of plastic or crumb rubber in the boards, to distinguish arctic boards from temperate climate boards, to distinguish between boards that support loads of 1 ton to loads of 5 tons.

Example 4

A black structural board might use 1000 pounds of colored high density polyethylene which is post consumer, with 35 pounds of shredded recycled rubber plus ¼ pounds of sodium bicarbonate (to prevent curling) with 1 pound of black colorant plus ultraviolet (UV) stabilizer plus antistatic material.

Example 5

A black structural board might use 1000 pounds of colored high density polyethylene which is post consumer, with 35 pounds of shredded recycled rubber plus ¼ pounds of sodium bicarbonate (to prevent curling) with 1 pound of black colorant plus antistatic material.

Example 6

A green structural board might use 1000 pounds of colored high density polyethylene which is post consumer, with 35 pounds of shredded recycled rubber plus ¼ pounds of sodium bicarbonate (to prevent curling) with 2 pounds of green colorant plus UV stabilizer, plus antistatic material.

Example 7

In this example, ground plastic particles made of 15 percent by weight high density polyethylene is used with 72 percent by weight low density polyethylene and 5 percent by weight polyethylene terephthalate. 2 percent by weight of ground rubber particulates can then be added which solely consist of post consumer shredded tires of styrene-butadiene rubber.

To these components are added ½ percent by weight baking soda, and 5 percent by weight slip resistant material made up of 2.5 percent by weight polyamide (a nylon 6), with 2 and ½ percent by weight ethyl vinyl acetate and ½ percent by weight of an antistatic material consisting essentially of carbon black.

While these embodiments have been described with emphasis on the embodiments, it should be understood that within the scope of the appended claims, the embodiments might be practiced other than as specifically described herein.

What is claimed is:

1. A temporary roadway formed from a static resistant, inter-connectable structural mat assembly configured to support construction equipment including excavators without rubber tires, bulldozers without rubber tires, other tireless heavy equipment, drag lines, and to be transported using conventional trucks on conventional roadways without a special permit, the roadway comprising:

a. a plurality of static resistant mats interconnected with one another, wherein each mat comprises:

i. a bottom layer of a first plurality of static resistant structural boards, wherein the static resistant structural boards are parallel to each other, wherein the plurality of static resistant structural boards are spaced apart inch from one another by from ¼ of an inch to ¾ of an inch, wherein the plurality of static resistant structural boards are oriented in a first longitudinal orientation, with alternating bottom static resistant structural boards extending beyond an adjacent bottom static resistant structural board as an extended portion while forming corresponding openings between adjacent bottom static resistant structural boards opposite the extended portions;

ii. a middle layer of a second plurality of static resistant structural boards, wherein static resistant structural boards of the second plurality of static resistant structural boards are parallel to one another, and wherein the static resistant structural boards of the second plurality of static resistant structural boards are spaced apart from one another by from ¼ of an inch to ¾ of an inch, wherein the second plurality of static resistant structural boards are in a second longitudinal orientation over the bottom layer, wherein the second orientation is at a 90 degree angle to the first orientation, and wherein the second plurality of static resistant structural boards; and iii. a top layer of a third plurality of structural boards, wherein the structural boards of the third plurality of structural boards are parallel to one another, and wherein the structural boards of the third plurality of structural boards are flush with one another or spaced apart from one another by up to ¾ of an inch, and wherein the third plurality of structural boards are oriented in the first longitudinal orientation over the middle structural boards;

b. a plurality of fasteners disposed through the top layer, the middle layer and the bottom layer, providing a static charge conduit; wherein each static resistant structural board of the top layer, the middle layer and bottom layers comprises:

i. from 50 percent by weight to 92 percent by weight based on the total blend of ground plastic particles, further comprising:

1. low density polyethylene; and 2. polyethylene terephthalate particles, in a ratio from 1:10 to 10:1;

ii. from 0.5 percent by weight to 3.9 percent by weight based on the total blend of ground styrene-butadiene rubber particles;

iii. from 2 percent by weight to 10 percent by weight based on the total blend of a antistatic particles for preventing static charge buildup, wherein the antistatic particles have a diameter from 1/16 of an inch to ¼ of an inch to allow for partial protrusion through a formed outer surface and randomized particle connections to facilitate dissipation of static charge build up in the structural boards, and creating a distribution of at least 10 particles per square inch; and iv. from 0.5 percent by weight to 5 percent by weight based on the total blend of an ultraviolet stabilizer material.

2. The temporary roadway of claim 1, wherein each of the top and bottom layer structural boards are from 8 feet to 12 feet long, 7 inches to 9 inches wide, and 1.5 inches to 2 inches thick.

3. The temporary roadway of claim 1, further wherein the antistatic particles dissipate static electrical buildup and maintaining voltage dissipation at or below $10^{-11}$ volts.

4. The temporary roadway of claim 1, further comprising using from 0.01 percent by weight to 3 percent by weight of the total weight, of a non-caustic soda with the ground plastic particles to prevent curling at temperatures below 45 degrees Fahrenheit.

5. The temporary roadway of claim 1, further comprising from 0.01 percent by weight to 3 percent by weight of the total weight, of a pigment with the ground plastic particles.

6. A temporary roadway consisting of a plurality of interlocking static resistant synthetic inter-connectable structural mats which can support vehicles, heavy equipment, provide resistance to corrosive materials, and be transported using conventional trucks on conventional roadways without a special permit, wherein the temporary roadway comprises:

a. a plurality of static resistant mats interconnected with one another, wherein each mat comprises:

i. a bottom layer of a first plurality of static resistant structural boards, wherein the static resistant structural boards are parallel to each other, wherein the plurality of static resistant structural boards are spaced apart inch from one another by from ¼ of an inch to ¾ of an inch, wherein the plurality of static resistant structural boards are oriented in a first longitudinal orientation, with alternating bottom static resistant structural boards extending beyond an adjacent bottom static resistant structural board as an extended portion while forming corresponding openings between adjacent bottom static resistant structural boards opposite the extended portions;

ii. a middle layer of a second plurality of static resistant structural boards, wherein static resistant structural boards of the second plurality of static resistant structural boards are parallel to one another, and wherein the static resistant structural boards of the second plurality of static resistant structural boards are spaced apart from one another by from ¼ of an inch to ¾ of an inch, wherein the second plurality of static resistant structural boards are in a second longitudinal orientation over the bottom layer, wherein the second orientation is at a 90 degree angle to the first orientation, and wherein the second plurality of static resistant structural boards;

iii. a top layer of a third plurality of structural boards, wherein the structural boards of the third plurality of structural boards are parallel to one another, and wherein the structural boards of the third plurality of structural boards are flush with one another or spaced apart from one another by up to ¾ of an inch, and wherein the third plurality of structural boards are oriented in the first longitudinal orientation over the middle structural boards; and iv. an upper L-shaped lip formed at each longitudinal end of each extended portion of each top structural board the top layer and a lower opposing L-shaped lip formed at each longitudinal end of each extended portion of each bottom structural board opposite the upper L-shaped lip, and wherein the upper L-shaped lips have a downwardly extending lip edge, the lower L-shaped lips having an upwardly extending lip edge allowing an upper L-shaped lip of a first mat to engage a lower L-shaped lip of a second mat allowing the mats to connect without the use of tools or other fasteners; and b. a plurality of fasteners disposed through the top layer, the middle layer and the bottom layer, providing a static charge conduit; wherein each static resistant structural board of the top layer, the middle layer and bottom layers comprises:

i. from 50 percent by weight to 92 percent by weight based on the total blend of ground plastic particles, further comprising:

1. low density polyethylene; and 2. polyethylene terephthalate particles, in a ratio from 1:10 to 10:1;

ii. from 0.5 percent by weight to 3.9 percent by weight based on the total blend of ground styrene-butadiene rubber particles;

iii. from 2 percent by weight to 10 percent by weight based on the total blend of a antistatic particles for preventing static charge buildup, wherein the antistatic particles have a diameter from 1/16 of an inch to 1/4 of an inch to allow for partial protrusion through a formed outer surface and randomized particle connections to facilitate dissipation of static charge build up in the structural boards, and creating a distribution of at least 10 particles per square inch; and iv. from 0.5 percent by weight to 5 percent by weight based on the total blend of an ultraviolet stabilizer material.

7. The temporary roadway of claim 6, further wherein the antistatic particles dissipate static electrical buildup and maintaining voltage dissipation at or below $10^{-11}$ volts.

8. The temporary roadway of claim 6, further comprising a slip resistant material embedded in discontinuous portions on the outer surface of each static resistant structural board member.

9. The temporary roadway of claim 8, wherein the slip resistant material is a member of the group consisting of: a silica based material, a crumb rubber, and combinations thereof.

10. The temporary roadway of claim 6, further comprising from 0.01 percent by weight to 3 percent by weight of the total weight, of a non-caustic soda blended the ground plastic particles to prevent curling at temperatures below 45 degrees Fahrenheit.

11. The temporary roadway of claim 6, further comprising 0.01 percent by weight to 3 percent by weight of the total weight, of a pigment blended with the ground plastic particles.

12. The temporary roadway of claim 6, further comprising a groove formed in the top layer structural boards.

13. The temporary roadway of claim 6, wherein the lips are an integral one piece structure with the boards.

* * * * *